US008251615B2

(12) United States Patent
Finn

(10) Patent No.: US 8,251,615 B2
(45) Date of Patent: Aug. 28, 2012

(54) SYSTEM AND METHOD FOR RELEASING A BARGE FROM A TOPSIDE DURING A FLOAT-OVER INSTALLATION

(75) Inventor: Lyle David Finn, Sugarland, TX (US)

(73) Assignee: Horton Wison Deepwater, Inc., Houston, TX (US)

( * ) Notice: Subject to any disclaimer, the term of this patent is extended or adjusted under 35 U.S.C. 154(b) by 307 days.

(21) Appl. No.: 12/163,218

(22) Filed: Jun. 27, 2008

(65) Prior Publication Data

US 2009/0003937 A1 Jan. 1, 2009

Related U.S. Application Data

(60) Provisional application No. 60/946,647, filed on Jun. 27, 2007.

(51) Int. Cl.
*E02D 23/02* (2006.01)

(52) U.S. Cl. ..... 405/205; 405/203; 405/209

(58) Field of Classification Search ..... 405/195.1, 405/203, 205, 206, 209; 114/45, 260, 266; 403/2; 411/390
See application file for complete search history.

(56) References Cited

U.S. PATENT DOCUMENTS

| | | | | |
|---|---|---|---|---|
| 3,405,593 | A * | 10/1968 | Kriesel | 411/20 |
| 4,106,875 | A * | 8/1978 | Jewett | 403/2 |
| 4,662,788 | A * | 5/1987 | Kypke et al. | 405/204 |
| 4,761,097 | A * | 8/1988 | Turner | 405/204 |
| 4,848,967 | A * | 7/1989 | Weyler | 405/204 |
| 4,930,938 | A * | 6/1990 | Rawstron et al. | 405/204 |
| 5,219,451 | A * | 6/1993 | Datta et al. | 405/204 |
| 5,403,124 | A * | 4/1995 | Kocaman et al. | 405/209 |
| 6,299,383 | B1 * | 10/2001 | Finn et al. | 405/209 |

* cited by examiner

*Primary Examiner* — John Kreck
*Assistant Examiner* — Benjamin Fiorello
(74) *Attorney, Agent, or Firm* — Conley Rose, P.C.

(57) ABSTRACT

A quick-release system for coupling a topside for a fixed or floating platform and a barge for float-over installation of the topside is disclosed. The quick-release system comprises one or more releasable connections, each releasable connection configured to support at least a fraction of the weight of the barge and to be remotely actuated to allow the barge to decouple from the topside. In some embodiments, the quick-release system comprises two plates, one coupled to the topside and the other coupled to the barge, and a plurality of bolts extending therebetween. A frangible nut is coupled to each bolt. The quick-release system is actuatable by an electric signal that causes the frangible nuts to fracture and the barge to subsequently be released from the topside.

17 Claims, 4 Drawing Sheets

SYSTEM AND METHOD FOR RELEASING A BARGE FROM A TOPSIDE DURING A FLOAT-OVER INSTALLATION

CROSS REFERENCE TO RELATED APPLICATIONS

This application claims benefit of U.S. provisional application Ser. No. 60/946,647 filed Jun. 27, 2007, and entitled "Big Foot and Docking Probe," which is hereby incorporated herein by reference in its entirety for all purposes.

STATEMENT REGARDING FEDERALLY SPONSORED RESEARCH OR DEVELOPMENT

Not applicable.

BACKGROUND OF THE INVENTION

Embodiments of the invention relate to systems and methods for installing a topside or deck on a substructure to form a fixed or floating offshore platform. More particularly, embodiments of the invention relate to a novel system and method for releasing a barge from the topside after float-over installation of the topside on the substructure.

Float-over installations offer opportunities to install heavy topsides beyond the lifting capacity of available crane vessels on offshore substructures located in remote areas. A float-over installation includes four primary procedures. The first procedure involves transporting the topside or deck to the offshore substructure. Typically, the topside is placed on a barge or heavy transport vessel and towed to the substructure.

The second procedure involves docking the transport barge to the installed substructure. The barge is maneuvered into the slot of the substructure, such that the topside is floated over and substantially aligned with the substructure. Once in the slot, mooring lines, sometimes in combination with a fendering system, are utilized to suppress surge and sway motions of the barge. After the mooring lines are set, deballasting of the substructure commences.

The third procedure involves transferring the load of the topside from the barge to the substructure, and is a critical phase of the float-over installation. Deballasting of the substructure continues as the substructure rises toward the topside. Once the topside and the substructure reach close proximity, the two bodies may impact each other repeatedly due to wave action. Such impacts may damage the structures when the relative motion between the two bodies is not controlled. As deballasting of the substructure continues, the weight of the topside is gradually transferred from the barge to the substructure. After a critical fraction of the weight is transferred, the relative motion between the two bodies ceases. At that point, the two structures move as a single unit, and the possibility of damage due to hard impact is eliminated. Therefore, it is desirable to complete the load transfer up to the critical fraction as quickly as possible.

After the topside is fully supported by the substructure, the legs of the two structures are coupled by welding legs extending downward from the topside to legs extending upward from the substructure. To achieve the high quality welds required to withstand the harsh load regimes of offshore environments, proper alignment of the topside with the substructure during the float-over operation is critical.

The final procedure involves separating the barge from the topside, and is also a critical phase of the float-over installation. The substructure is deballasted further until the topside separates from the barge. At and immediately after separation, the relative motions between barge and topside pose a danger of damage due to impact between these bodies. That danger can be minimized by rapid separation of the barge and the topside. To promote such rapid separation, the topside may be supported on the barge by a number of loadout shoes. At the appropriate time, the loadout shoes are actuated to quickly collapse or retract, thereby providing rapid separation between the barge and the topside. These systems, however, have a propensity to malfunction and permit hard contact between the loadout shoes and the topside. In any event, hard contact between the barge and the topside may continue until the substructure is deballasted to provide sufficient separation between the barge and the topside. After which point, the barge is towed from the installation site.

Thus, embodiments of the invention are directed to apparatus and methods that seek to overcome these and other limitations of the prior art.

SUMMARY OF THE PREFERRED EMBODIMENTS

A quick-release system for coupling a topside for a fixed or floating platform and a barge for float-over installation of the topside is disclosed. The quick-release system includes one or more releasable connections, each releasable connection configured to support at least a fraction of the weight of the barge and to be remotely actuated to allow the barge to decouple from the topside.

Some methods for releasing a barge from a topside during float-over installation of the topside on a substructure include coupling a quick-release system between the barge and the topside, deballasting the substructure to raise the topside and the barge, and actuating the quick-release system to allow the barge to decouple from the topside.

In some embodiments, the quick-release system includes a first plate coupled to the topside and a second plate coupled between the barge and the first plate. Each plate comprises a plurality of throughbores aligned with the throughbores of the other plate. A bolt is inserted through each pair of aligned throughbores, and a frangible nut is coupled to the bolt. The frangible nut may be configured to fracture upon application of an electric signal.

Thus, the embodiments of the invention comprise a combination of features and advantages that enable substantial enhancement of float-over installation apparatus and methods. These and various other characteristics and advantages of the invention will be readily apparent to those skilled in the art upon reading the following detailed description of the preferred embodiments of the invention and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
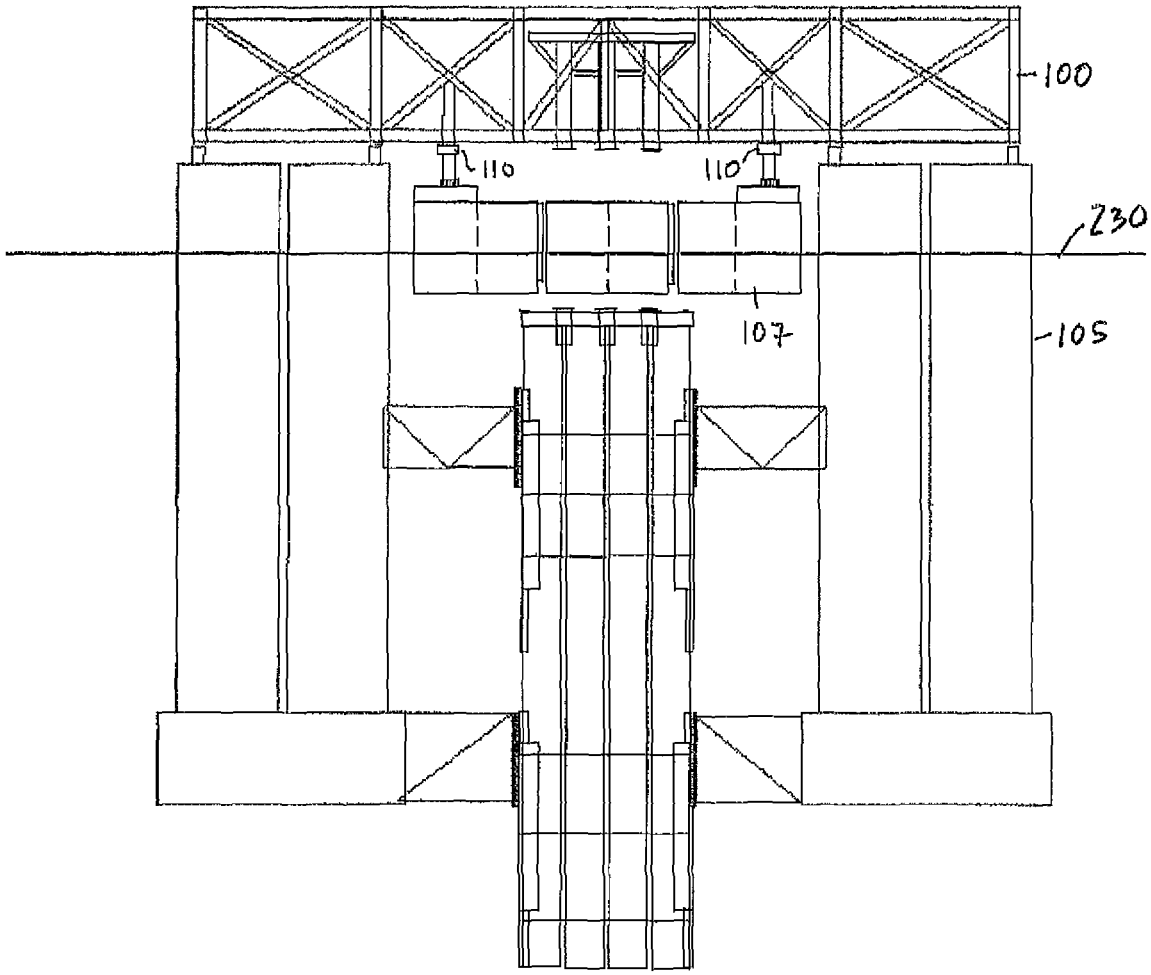
FIG. 1 is a cross-sectional view of a barge quick-release system in accordance with embodiments of the invention coupled between a topside and a barge.

Various embodiments of the invention will now be described with reference to the accompanying drawings, wherein like reference numerals are used for like parts throughout the several views. The drawing figures are not necessarily to scale. Certain features of the invention may be shown exaggerated in scale or in somewhat schematic form, and some details of conventional elements may not be shown in the interest of clarity and conciseness.

Preferred embodiments of the invention relate to a quick-release system and method for disengaging a barge from a topside after float-over installation of the topside on an installed fixed or floating substructure. The invention is susceptible to embodiments of different forms. There are shown in the drawings, and herein will be described in detail, specific embodiments of the invention with the understanding that the disclosure is to be considered an exemplification of the principles of the invention and is not intended to limit the invention to that illustrated and described herein. It is to be fully recognized that the different teachings of the embodiments discussed below may be employed separately or in any suitable combination to produce desired results.

As described above, during a conventional float-over installation of a topside on an installed semi-submersible substructure, the topside is floated over and substantially aligned with the substructure using a barge. The substructure is then deballasted to engage and lift the topside from the barge, thereby assembling the semi-submersible platform. The topside is then coupled to the substructure by welding, and the barge is released from the topside. Embodiments of the invention are directed to systems and methods for quickly releasing the barge from the topside so as to prevent subsequent contact between the barge and the topside.

FIG. 1 depicts a topside or deck 100 that has been floated over a substructure 105 for a semi-submersible offshore platform, such as a multicolumn floating (MCF) platform, by a barge 107. A quick-release system 110 in accordance with the principles disclosed herein is coupled between topside 100 and barge 107. Quick-release system 110 is configured to allow barge 107 to be lifted with topside 100 as structure 105 is deballasted from the position shown in FIG. 1. In other words, the structural integrity of quick-release system 110 is capable of sustaining at least a fraction of the weight of barge 107 while remaining engaged with barge 107 and topside 100 as substructure 105 is deballasted, raising both topside 100 and barge 107 coupled thereto.

Figure 2:
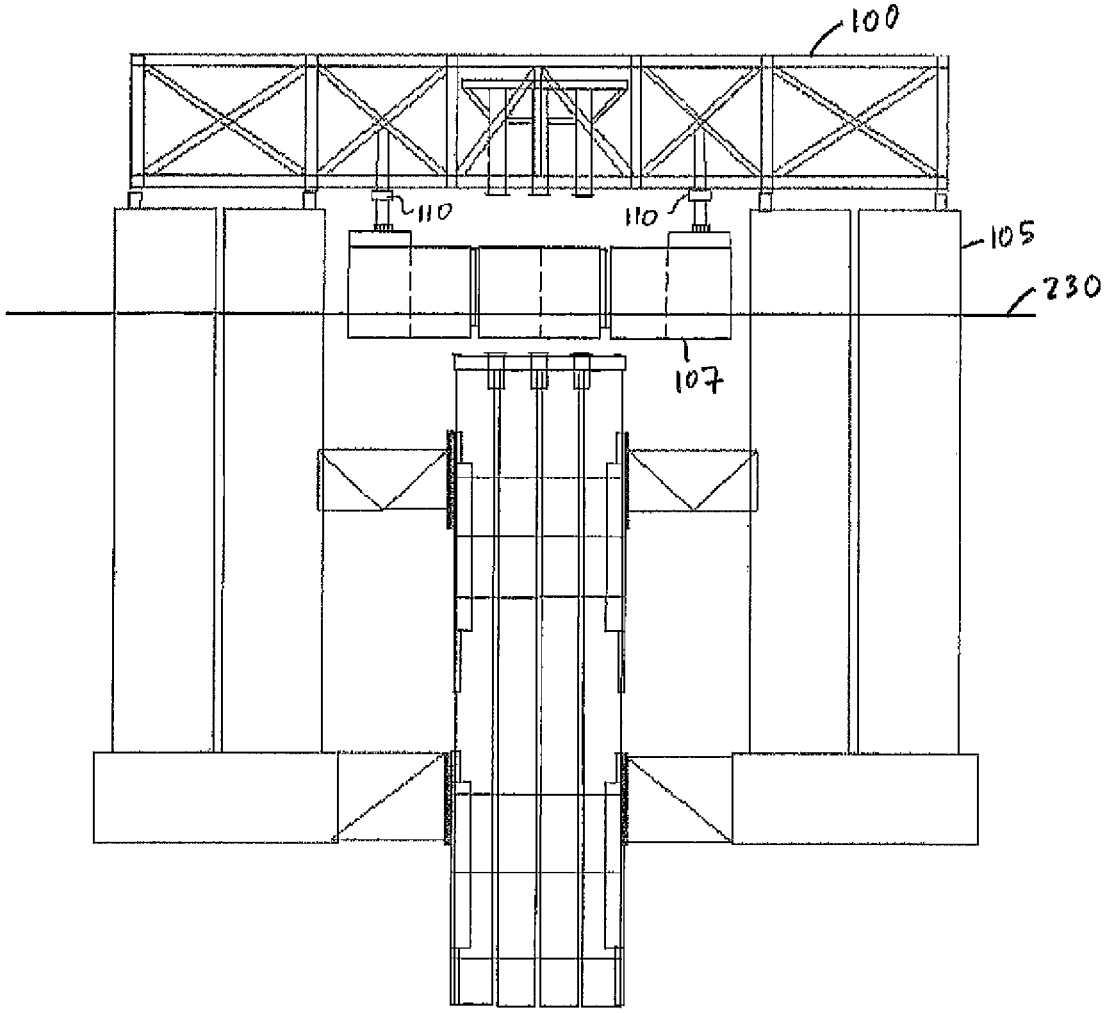
FIG. 2 is a cross-sectional view of the topside and the barge with the quick-release system coupled therebetween of FIG. 1 after further deballasting of the substructure to raise the topside and the barge.

Turning to FIG. 2, substructure 105 has been deballasted to lift and support topside 100. Due to the coupling of quick-release system 110 between topside 100 and barge 107, deballasting of substructure 105 has also lifted to some degree barge 107, as indicated by the change in the vertical positions of barge 107, substructure 105 and topside 100 relative to the surrounding water 230. Thus, substructure 105 supports the entire load of topside 100 and the uplift force associated with the upward displacement of barge 107 created by deballasting of substructure 105.

Figure 3:
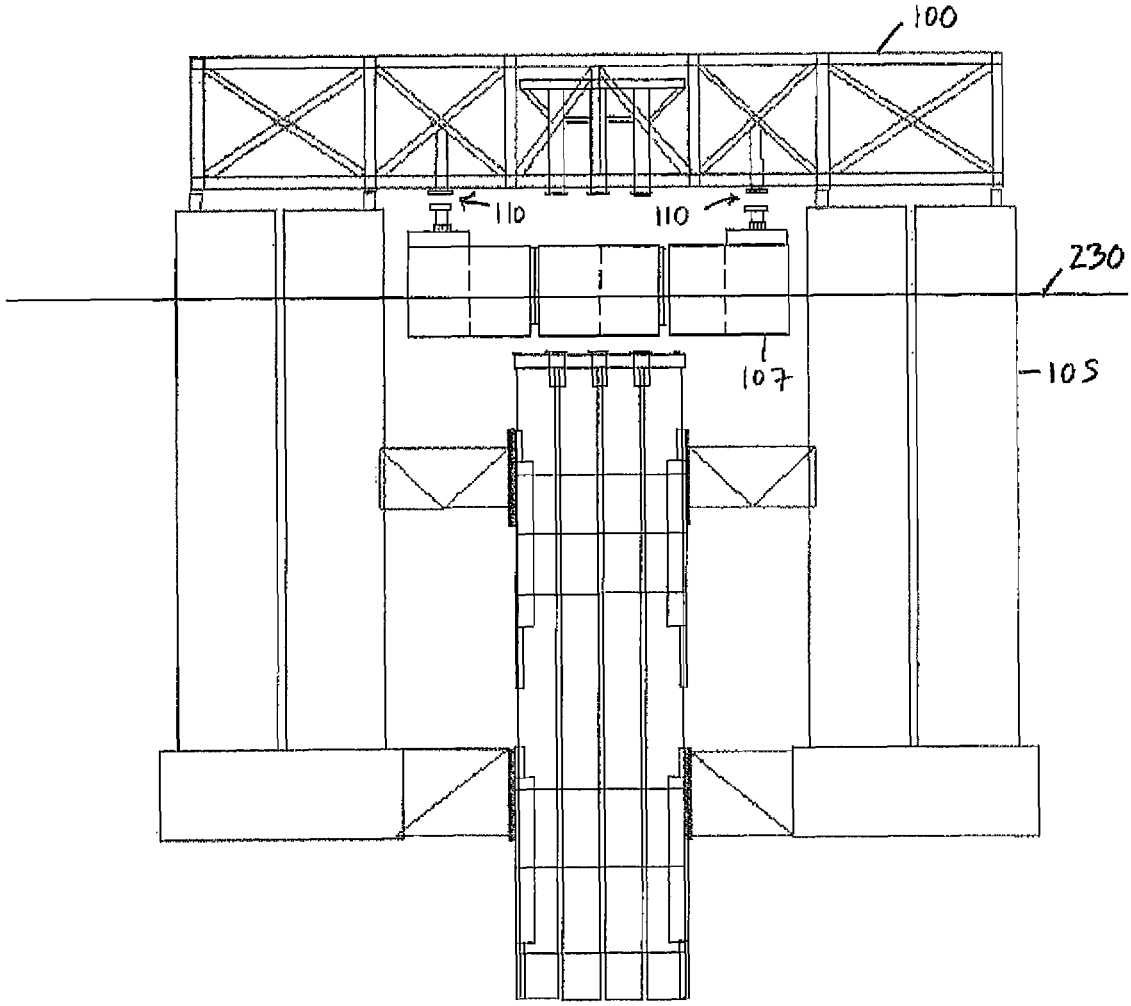
FIG. 3 is a cross-sectional view of the topside and the barge with the quick-release system coupled therebetween of FIG. 2 after the barge has been released.

Referring next to FIG. 3, quick-release system 110 is also configured to allow release of barge 107 from topside 100 upon remote actuation of system 110 such that barge 107 subsequently displaces rapidly downward, resulting in separation between topside 100 and barge 107 that prevents further contact between barge 107 and topside 100 as barge 107 moves with the surrounding water 230. The separation between topside 100 and barge 107 created in this manner is provided by the rapid downward displacement of barge 107, upon actuation of quick release system 110, and the simultaneous upward displacement of substructure 105 upon removal of the uplift force acting on substructure 105 when barge 107 is released. Because barge 107 has a larger water plane surface area than substructure 105, the upward displacement of substructure 105 will be greater than the downward displacement of barge 107. The combined relative displacement of barge 107 and substructure 105, with topside supported thereon, provides sufficient separation between topside 100 and barge 107 such that barge 107 does not contact topside 100 subsequent to release of barge 107 from topside 100.

Figure 4:
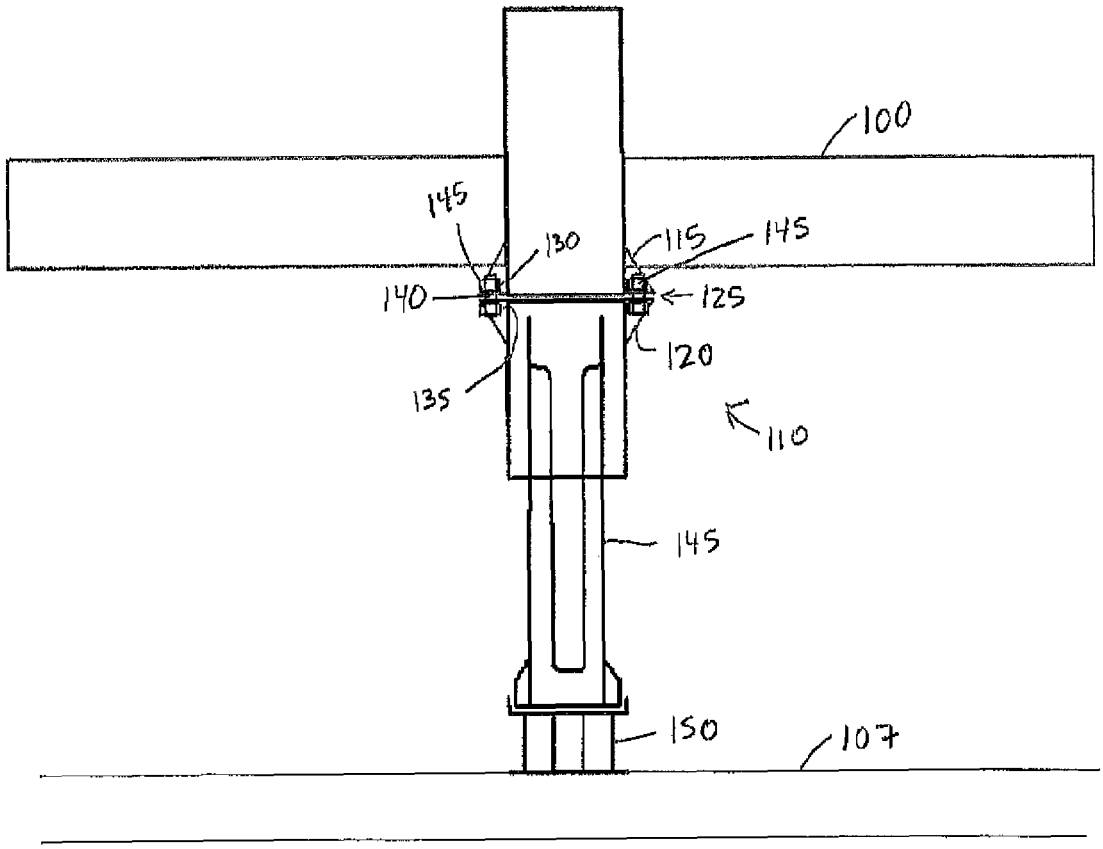
FIG. 4 is a cross-sectional view of an embodiment of the barge quick-release system of FIG. 1.

Turning lastly to FIG. 4, in some embodiments, quick-release system 110 includes a flanged plate 115 coupled to topside 100, a flanged plate 120 coupled to barge 107, and a plurality of releasable connections 125 coupled therebetween. Flanged plates 115, 120 include a plurality of aligned throughbores 130, 135, respectively. A releasable connection 125 is inserted through each pair of aligned throughbores 130, 135 to couple flanged plates 115, 120. Each releasable connection 125 includes a bolt 140 with a frangible nut 145 coupled thereto. The combined strength of releaseable connections 125 is capable of supporting at a least a fraction of the weight of barge 107. Moreover, releasable connections 125 are remotely actuatable, for example, by electric signal, to enable fracturing of nuts 145, thereby allowing plate 120 with barge 107 coupled thereto to separate from plate 115 and topside 100. Although in this exemplary embodiment, releasable connections 125 include frangible nuts 145 coupled to bolts 140, other types of releasable connections 125 may be equivalently used. Moreover, in some embodiments, a skid shoe 145 and a skid beam 150 may be coupled between quick-release system 110 and barge 107.

All components of quick-release system 110 are preferably installed prior to transport of topside 100 by barge 107 to the offshore installation site. Upon arriving at the installation site, topside 100 is installed over substructure 105 in accordance with conventional float-over installation methods. After topside 100 is aligned over substructure 105, substructure 105 is deballasted to engage topside 100. Continued deballasting of substructure 105 enables load transfer of topside 100 from barge 107 to substructure 105, as shown in FIG. 1.

Further deballasing of substructure 105 allows substructure 105 to fully support topside 100 and to raise and support barge 107, as shown in FIG. 2. When it is desired to release barge 107 from topside 100, quick-release system 110 is actuated, and frangible nuts 145 are fractured. Plate 120 with bolts 140 coupled thereto disengage from plate 115. As shown in FIG. 3, barge 107 rapidly descends from its somewhat elevated position, and in response, substructure 105 rises, creating separation between topside 100 and barge 107 that enables barge 107 to subsequently maneuver away from the now-assembled semi-submersible platform without further contact with topside 100.

While preferred embodiments have been shown and described, modifications thereof can be made by one skilled in the art without departing from the scope or teachings herein. The embodiments described herein are exemplary only and are not limiting. Many variations and modifications of the systems are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A quick-release system for coupling a topside and a barge for float-over installation of the topside, the quick-release system comprising:

one or more releasable connections, each connection coupling the topside and the barge;

wherein each releasable connection is configured to support at least a fraction of the weight of the barge;

wherein each releasable connection is configured to be remotely actuatable to decouple the barge from the topside;

a first plate coupled to the topside, wherein the first plate comprises a first plurality of throughbores;

a second plate coupled between the barge and the first plate, wherein the second plate comprises a second plurality of throughbores aligned with the first plurality of throughbores;

wherein each releasable connection comprises:

a bolt inserted through each pair of aligned throughbores; and a frangible nut coupled to each bolt and actuatable to fail;

wherein the second plate is configured to decouple from the first plate upon failure of each of the frangible nuts.

2. The quick-release system of claim 1, wherein the fraction of the weight supported by the one or more releasable connections is such that downward displacement of the barge and upward displacement of the topside resulting from decoupling the barge from the topside by actuation of the one or more releasable connections prevents any subsequent contact between the barge and the topside.

3. The quick-release system of claim 1, wherein the one or more releasable connections are configured to be actuatable by an electric signal.

4. The quick-release system of claim 1, wherein a portion of the one or more releasable connections is configured to structurally fail upon actuation.

5. The quick-release system of claim 1, wherein the bolts are configured to support at least a fraction of the weight of the barge.

6. The quick-release system of claim 1, wherein each frangible nut is configured to fracture upon application of an electric signal.

7. The quick-release system of claim 6, wherein the bolts are oriented to permit the second plate to decouple from the first plate when the frangible nuts fracture.

8. The quick-release system of claim 6, wherein the electric signal originates from a remote location.

9. The quick-release system of claim 8, wherein the fraction of the weight supported by the bolts is such that downward displacement of the barge and upward displacement of the topside resulting from decoupling of the second plate from the first plate prevents any subsequent contact between the barge and the topside.

10. A method for releasing a barge from a topside during float-over installation of the topside, the method comprising:

coupling a quick-release system between the barge and the topside, the quick-release system comprising one or more releasable connections, each connection coupling the topside and the barge;

supporting at least a fraction of the weight of the barge with the one or more releasable connections;

deballasting a substructure to raise the topside and the barge, whereby the substructure supports the topside and at least a portion of the barge; and actuating the one or more releasable connections to allow the barge to decouple from the topside.

11. The method of claim 10, further comprising displacing the barge downward and the substructure upward.

12. The method of claim 11, wherein the relative displacement of the barge from the substructure is sufficient to prevent subsequent contact between the barge and the topside.

13. The method of claim 10, wherein the one or more releasable connections each comprises a frangible component and wherein the actuating comprises fracturing the frangible components.

14. The method of claim 13, wherein the actuating further comprises receiving an electric signal.

15. The method of claim 14, wherein the electric signal originates from a locate remote to the quick-release system.

16. The method of claim 13, wherein the frangible components are nuts, each nut coupled to a bolt.

17. The method of claim 10, wherein the one or more releasable connections each comprises a bolt configured to support at least a fraction of the weight of the barge.

* * * * *